US006826936B1

(12) United States Patent
Ming-Er et al.

(10) Patent No.: US 6,826,936 B1
(45) Date of Patent: Dec. 7, 2004

(54) BURGLARPROOF LOCK CORE WITH PLATE TUMBLERS

(76) Inventors: Hsieh Ming-Er, No. 285, Chien-Fu Rd., Taichung Shien, Tai-Ping City (TW); Lin Jin, No. 285, Chien-Fu Rd., Taichung Shien, Tai-Ping City (TW)

( * ) Notice: Subject to any disclaimer, the term of this patent is extended or adjusted under 35 U.S.C. 154(b) by 0 days.

(21) Appl. No.: 10/748,130

(22) Filed: Dec. 31, 2003

(51) Int. Cl.[7] ..... E05B 29/00; E05B 31/00

(52) U.S. Cl. ..... 70/360; 70/353; 70/365; 70/367; 70/372; 70/377

(58) Field of Search ..... 70/349, 353, 360–361, 70/365–367, 370–372, 375, 377, 387, 421, 490, 495

(56) References Cited

U.S. PATENT DOCUMENTS

| | | | | | |
|---|---|---|---|---|---|
| 1,893,142 | A | * | 1/1933 | Jacobi | 70/492 |
| 1,987,735 | A | * | 1/1935 | Morris | 70/368 |
| 2,039,244 | A | * | 4/1936 | Lowe | 70/368 |
| 2,217,047 | A | * | 10/1940 | Fitzgerald | 70/366 |
| 4,008,588 | A | * | 2/1977 | Miller et al. | 70/366 |
| 4,062,211 | A | * | 12/1977 | Miller et al. | 70/366 |
| 4,370,875 | A | * | 2/1983 | Piiroinen | 70/422 |
| 4,651,546 | A | * | 3/1987 | Evans | 70/366 |
| 4,838,055 | A | * | 6/1989 | Gallagher | 70/208 |
| 4,920,774 | A | * | 5/1990 | Martin | 70/367 |
| 5,388,438 | A | * | 2/1995 | Haavikko Paavo | 70/366 |
| 6,644,078 | B1 | * | 11/2003 | Hung | 70/491 |
| 6,725,696 | B1 | * | 4/2004 | Blight et al. | 70/366 |

* cited by examiner

*Primary Examiner*—Daniel P. Stodola
*Assistant Examiner*—Christopher Boswell
(74) *Attorney, Agent, or Firm*—Dennison, Schultz, Dougherty & MacDonald

(57) ABSTRACT

A lock has an outer housing, which has an outer slot at an interior side. An inner housing is received in the outer housing for rotation and has an inner slot and a driving section. Three locking plates are received in the inner housing, each of which has and a recesses at a periphery thereof. A movable pin is moved to be received either in the inner and outer slots or in the inner slot and the recesses. A first tumbler pin is provided at the outer housing and has an end received either in the annular slot or in the position slot. The inner housing is reciprocated between a first position, in which the position pin is moved to a position slot to restrain the inner housing from rotation, and a second position, in which the position pin is moved to an annular slot to release the inner housing.

7 Claims, 6 Drawing Sheets

BURGLARPROOF LOCK CORE WITH PLATE TUMBLERS

BACKGROUND OF THE INVENTION

1. Field of the Invention

The present invention relates generally to a lock, and more particularly to a lock, which the lock still has function of burglarproof while the core is turning.

2. Description of the Related Art

A conventional lock used in a door or a draw of a cupboard has multi-section of lock. User has to turn the key for 720 degrees or more to unlock the lock. Such lock has a poor capacity of burglarproof. If the thief can turn the core of such lock by a specific tool, it is sure to turn the core continuously until the lock is unlocked. In other words, if the thief breaks the first section of lock of the conventional lock, the second and the third section of lock are released at the same time.

SUMMARY OF THE INVENTION

The primary objective of the present invention is to provide a lock, which has a superior function of burglarproof.

The secondary objective of the present invention is to provide a lock, which the lock still has function of burglarproof while the core is turned by a key tool.

According to the objectives of the present invention, a lock comprises an outer housing, which is open at an end thereof and is closed at the other end thereof, having an outer slot at an interior side thereof and a key bore at the closed end thereof. An inner housing is received in the outer housing for rotation between a predetermined angle, wherein the inner housing has an inner slot, which is open at both an interior side and an exterior side thereof, and a driving section. A plurality of locking plates are received in the inner housing in sequence and rotated between a predetermined angle, each of which has a key bore at a center thereof and a recess at a periphery thereof. A movable pin has a predetermined length to be moved between two positions in which the movable pin is received either in the inner slot of the inner housing and the outer slot of the outer housing or in the inner slot of the inner housing and the recesses of the locking plates. The inner housing is reciprocated in the outer housing between a first position and a second position and has an annular slot and a position slot, which is communicated with the annular slot, at the exterior side thereof. A first tumbler pin is provided at the outer housing and has an inner end thereof received either in the annular slot or in the position slot of the inner housing. The position pin is moved to the position slot of the inner housing to restrain the inner housing from rotation while the inner housing is moved to the first position and the position pin is moved to the annular slot of the inner housing to release the inner housing for free rotation while the inner housing is moved to the second position.

DETAILED DESCRIPTION OF THE INVENTION

Figure 1:
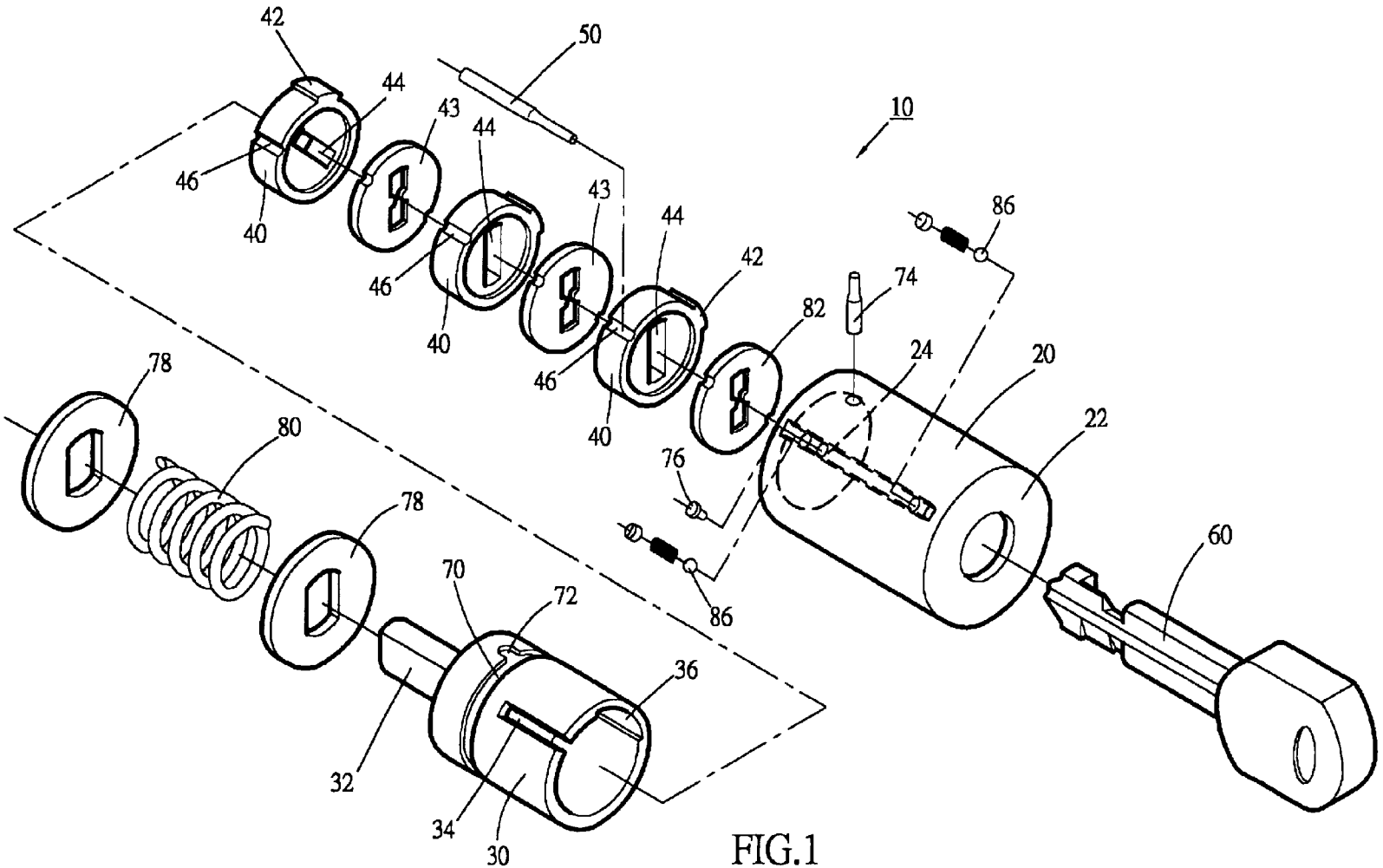
FIG. 1 is an exploded view of a first preferred embodiment of the present invention.

As shown in FIGS. from FIG. 1 to FIG. 5, a lock 10 of the first preferred embodiment of the present invention mainly comprises an outer housing 20, an inner housing 30 received in the outer housing 20, a plurality of locking plates 40 mounted in the inner housing 30 and a movable pin 50.

The outer housing 20 is open at an end thereof and is closed the other end thereof. The closed end of the outer housing 20 is defined as a bottom 22 and on a center of which has a bore. At an interior side of the outer housing 20 is an outer slot 24, which is extended from the open end of the outer housing 20.

The inner housing 30 is open at an end thereof and is closed the other end thereof. A driving section 32 is provided at an exterior side of the closed end of the inner housing 30. An inner slot 34 is extended from the open end of the inner housing 30 and the inner slot 34 is open both at an exterior side and an interior side of the inner housing 30. A restrain portion 36, which is a recess in the present invention, is provided at the interior side of the inner housing 30 having a suitable width and depth.

The locking plates 40, which are round discs in the present invention, are mounted in the inner housing 30 for free rotation. The locking plates 40 each have a protrusion 42 and a recess 46 at a periphery thereof, wherein the protrusions 42 are received in the restrain portion 36 of the inner housing 30 so that the locking plates 40 are restrained by the width of the restrain portion 36 for rotation between a predetermined angle. A key bore 44 is provided at a center of the locking plate 40. A key 60 is inserted into the key bores 44 of the locking plates 40 via the bore of the outer housing 30 to turn the locking plates 40.

The movable pin 50 has a predetermined length and diameter to be received either in both of the inner slot 34 and the outer slot 24 or in the inner slot 34 and the recesses 46 of the locking plates 40.

The main character of the present invention is described hereunder.

The inner housing 30 is reciprocated in the outer housing 20 between a first position and a second position. Wherein the exterior side of the inner housing 30 further has an annular slot 70 and a position slot 72 between the driving section 32 and the annular slot 70 and the position slot 72 is communicated with the annular slot 70.

A first tumbler pin 74 is mounted in a first hole of the outer housing 20 having an inner end in the outer housing 20 and received either in the annular slot 70 or the position slot 74 of the inner housing 30.

A second tumbler pin 76 is mounted in a second hole of the outer housing 20 having an inner end in the outer housing 20 and received in the outer slot 24. The inner end of the second tumbler pin 76 does not contact the inner housing 30, it points to a portion of the inner housing 30 between the inner slot 34 and the driving section 32.

Figure 2:
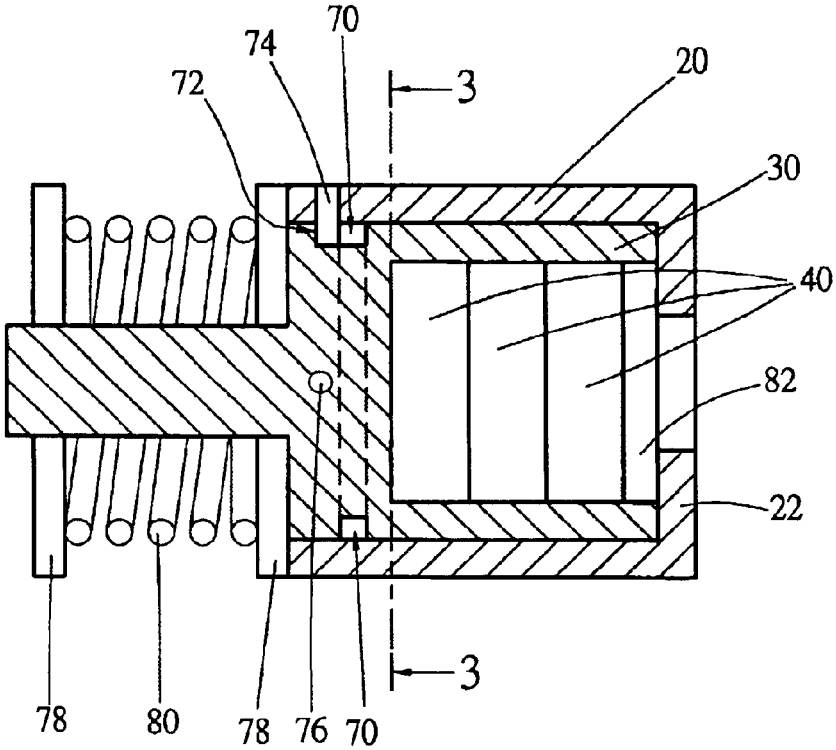
FIG. 2 is a sectional view of the first preferred embodiment of the present invention, showing the inner housing at the first position.
Figure 3:
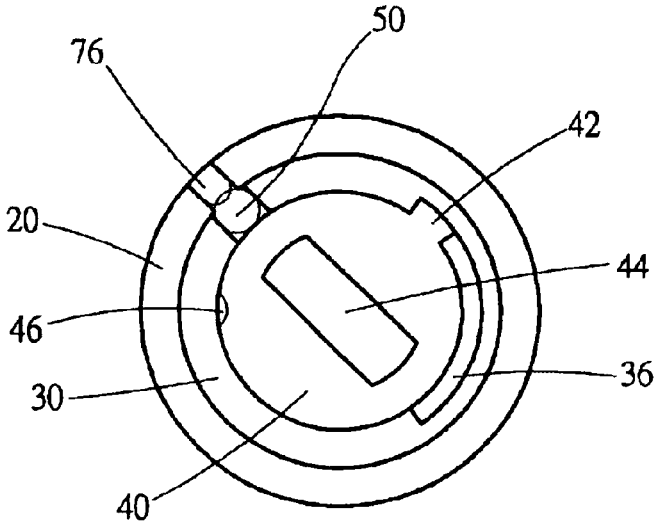
FIG. 3 is a sectional view along the 3—3 line of FIG. 2.

While the lock 10 of the present invention is unlocked, the movable pin 50 is received in both the outer and inner slots 24 and 34 and the locking plates 40 are freely rotated in the inner housing 30. The first tumbler, pin 74 is received in the position slot 72 to restrain the inner housing 30 from rotation as shown in FIG. 2. The second tumbler pin 76 is positioned at a left end of the movable pin 50 to block it, so that the inner housing 30 is restrained again from shifting left as shown in FIG. 3.

Figure 4:
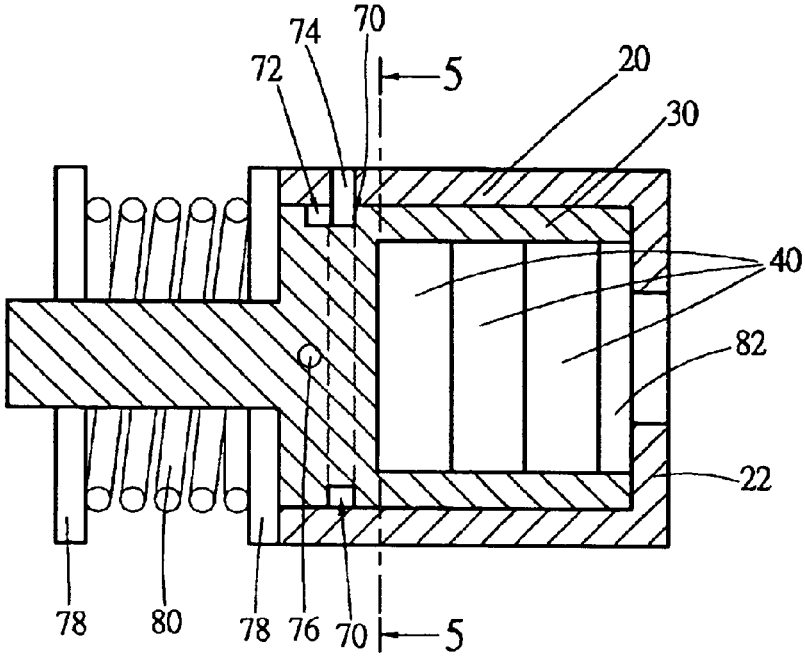
FIG. 4 is a sectional view of the first preferred embodiment of the present invention, showing the inner housing at the second position.
Figure 5:
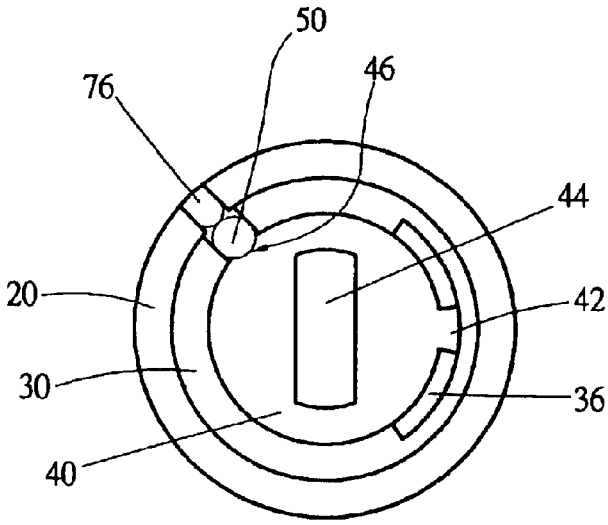
FIG. 5 is a sectional view along the 5—5 line of FIG. 4.

As shown in FIG. 4 and FIG. 5, while the lock 10 of the present invention is going to be unlocked, the locking plates 40 are turned by a key 60 to make the recesses 46 aligned with each other and the movable pin 50 is received in the inner slot 34 and the recesses 46. Under such condition, the locking plates 40 are coupled with the inner housing 30 and the key 60 can turn the driving section 32 of the inner housing 30 via the locking plates 40.

In the meantime, the movable pin 50, which is received in the inner slot 34 and the recesses 46, has moved away from the second tumbler pin 76 so that user can turn the key to shift the inner housing 30 left and further makes the inner end of the first tumbler pin 74 moving to the annular slot 70 from the position slot 72. The inner housing 30, therefore, is rotated freely in the outer housing 20.

To unlock the lock 10 of the present invention, the locking plates 40 have to be tuned to aforesaid condition and the inner housing 30 has to be moved to the second position from the first position. Double actions (turning the locking plates 40 and moving the inner housing 30) make the lock 10 of the present invention not easy to be unlocked by a common tool of a thief.

The driving section 32 is fitted with two pads 78 and a spring 80 between the pads. The spring 80 pushes the inner housing 30 to right at initial. The inner housing 30 is further provided with a cover 82 at the open end thereof. Two pads 43 are provided at between each two of the locking plates 40 respectively. Two sets of a first position ball 86 and a spring are installed in holes of the outer housing 20 and the first position balls 86 have portions exposed in the outer slot 24 and press the movable pin 50 to keep the movable pin 50 stable.

Figure 6:
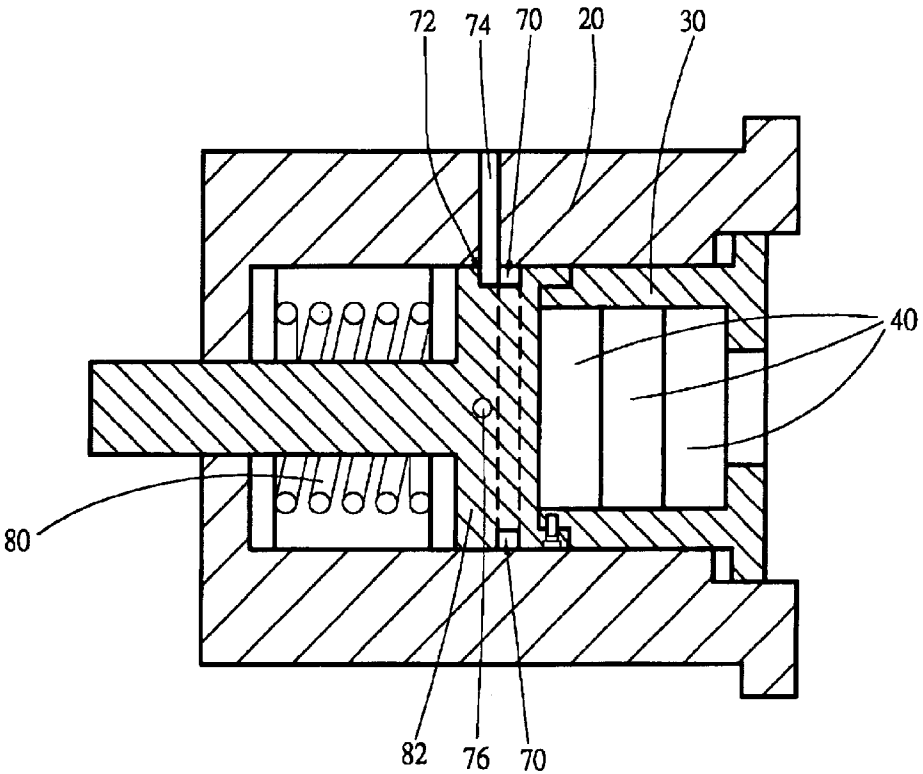
FIG. 6 is sectional view of a second preferred embodiment of the present invention.

As shown in FIG. 6, a lock of the second preferred embodiment of the present invention provides another assembly of an outer housing 20 and an inner housing 30. A driving section 32 is coupled with the inner housing 30 at an open end thereof by a pin 87. The driving section 32 is provided with an annular slot 70 and a position slot 72 at an outer surface thereof. The lock of the second preferred embodiment serves the same function.

Figure 7:
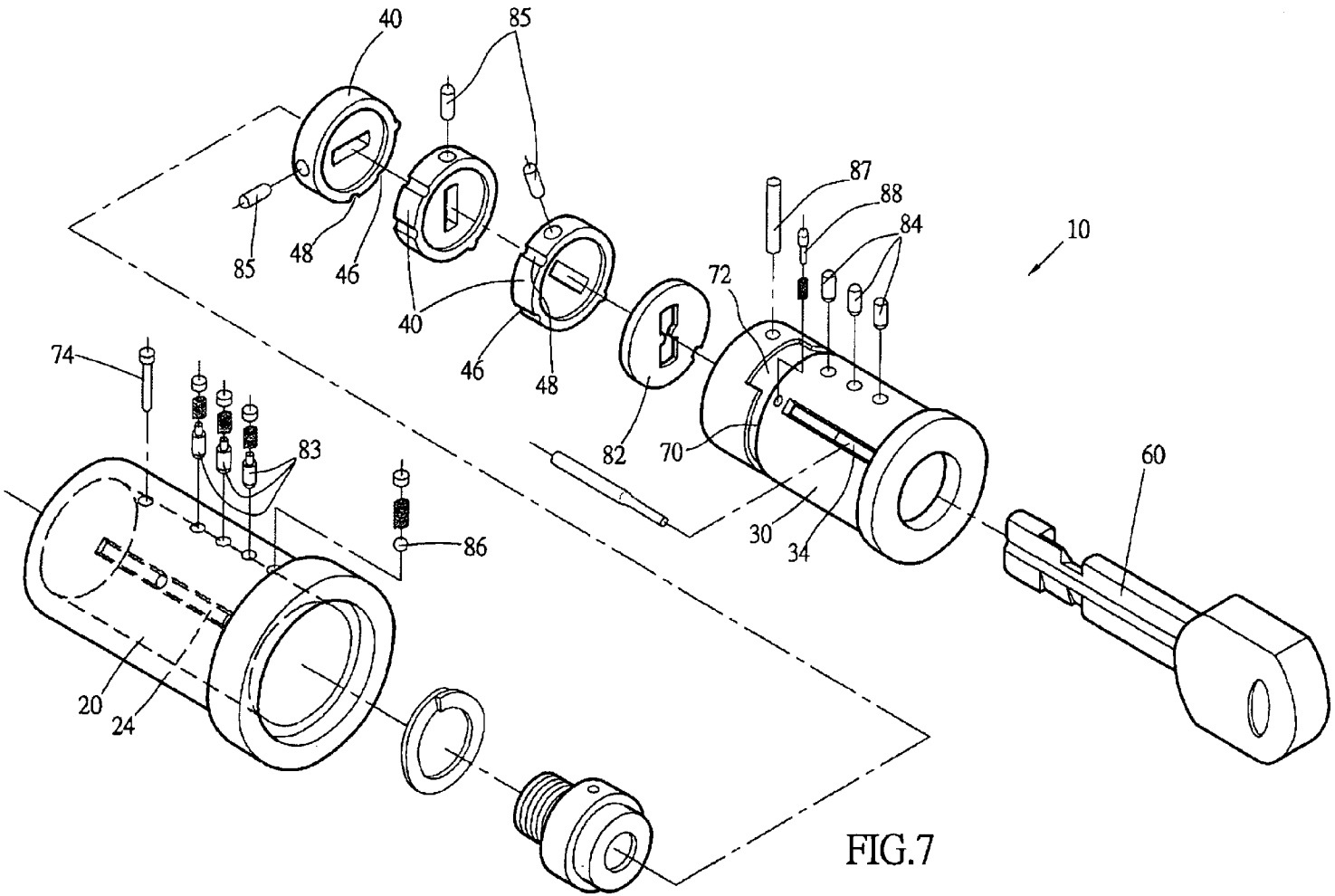
FIG. 7 is an exploded view of a third preferred embodiment of the present invention.
Figure 8:
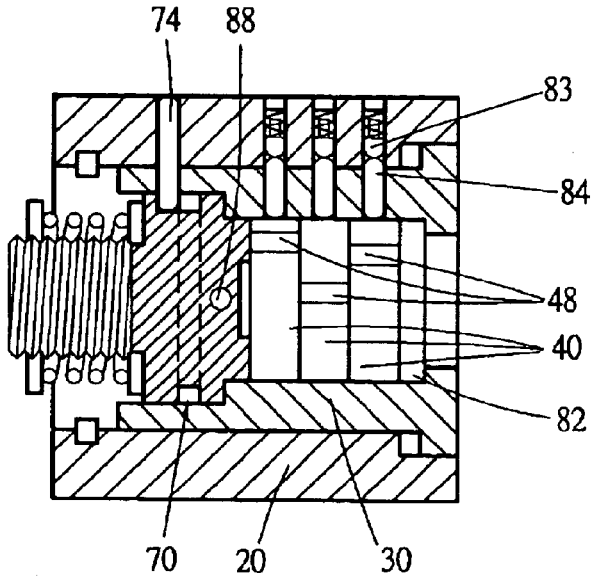
FIG. 8 is a sectional of the third preferred embodiment of the present invention.
Figure 9:
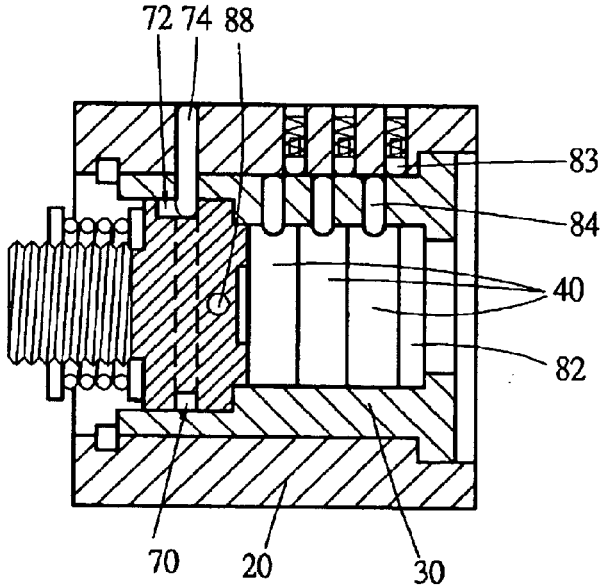
FIG. 9 is a sectional of the third preferred embodiment of the present invention.

As shown in FIG. 7, FIG. 8 and FIG. 9, a lock 10 of the third preferred embodiment of the present invention provides first locking pins 83, second locking pins 84 and third locking pins 85 in holes of an outer housing 20, an inner housing 30 and locking plates 40 for reciprocation. The inner housing 30 has a position slot 72 on an outer surface thereof and the position slot 72 has a length about ¼ of a circumference of the inner housing 30.

In operation, a key 60 is inserted into key bores of the locking plates 40 and pushes the third locking pins 85 outwardly to predetermined positions. The second locking pins 84, therefore, are not inserted into the locking plates 40 (not shown in FIG.). And then, the key 60 turns the locking plates 40 continuously and makes the second locking pins 84 received in both holes of the inner housing 30 and the outer housing 20, as shown in FIG. 8. Therefore, the inner housing 30 is secured by the outer housing 20 and only the locking plates 40 is turned by the key 60.

The locking plates 40 are turned by the key to where notches 48, which have various depths, on peripheries of the locking plates 40 are aligned with the second locking pins 84 respectively. At this moment, inner ends of the second locking pins 84 will drop into the notches 48 respectively and leave the holes of the outer housing 20 (as shown in FIG. 8), such that the inner housing 30 is turned along with the locking plates 40.

The key keeps being turned to turn the inner housing 30 to a predetermined position at where the movable pin 50 drops into an inner slot 34 of the inner housing 30 and recesses 46 on the periphery of the locking plates 40 respectively. Under such condition, a first tumbler pin 74 is able to slide along the position slot 72.

And then, the user can push the inner housing 30 to the left via the key 60, as shown in FIG. 9. In the meantime, the first tumbler pin 74 is moved to the annular slot 70 from the position slot 72 and the middle one of the second locking pins 84 is moved to where aligned with the middle one of the first locking pin 83 and pushes it to secure the inner housing 30 with the outer housing 20.

The inner housing 30 is provided with a second position ball 88 in a hole between the inner slot 34 and the annular slot 70. A spring is installed in the hole to push the second position ball 88. The second position ball 88 will have a portion dropping into the outer slot 24 from the inner slot 34 and provide a click sound and a resistance while the inner housing 30 is turned by the key and moves to the first position where the inner slot 34 is aligned with the outer slot 24. The sound and resistance give the user a hit that the inner housing 30 has arrived the right position. The second position ball 88 also can be provided on the inner housing 30 (not shown) and the outer housing 20 is provided with a recess (not shown). While the second position ball 88 drops into the recess, it will make a sound and a resistance too.

What is claimed is:

1. A lock, comprising:

an outer housing, which is open at an end thereof and is close at the other end thereof, having an outer slot at an interior side thereof and a key bore at the close end thereof;

an inner housing received in the outer housing for rotation between a predetermined angle, wherein the inner housing has an inner slot, which is open at both an interior side and an exterior side thereof, and a driving section;

a plurality of locking plates received in the inner housing in sequence and rotated between a predetermined angle, each of which has a key bore at a center thereof and a recesses at a periphery thereof;

a movable pin having a predetermined length to be moved between two positions in which the movable pin is received either in the inner slot of the inner housing and the outer slot of the outer housing or in the inner slot of the inner housing and the recesses of the locking plates;

wherein the inner housing is reciprocated in the outer housing between a first position and a second position and has an annular slot and a position slot, which is communicated with the annular slot, at the exterior side thereof, and a first tumbler pin provided at the outer housing and having an inner end thereof received either in the annular slot or in the position slot of the inner housing;

wherein the first tumbler pin is received to the position slot of the inner housing to restrain the inner housing from rotation while the inner housing is moved to the first position and the first tumbler pin is received to the annular slot of the inner housing to release the inner housing for free rotation while the inner housing is moved to the second position.

2. The lock as defined in claim 1, further comprising a second tumbler pin provided at the outer housing and having an end thereof located at where between the driving section and the movable pin and further located at where between a path of the movable pin moving along with the inner housing while the inner housing moves between the first position and the second position.

3. The lock as defined in claim 1, further comprising a first position ball provided at the outer housing and having a portion thereof exposed in the outer slot to support the movable pin.

4. The lock as defined in claim 1, wherein the driving section is coupled with the inner housing by a pin, wherein the driving section is fixed at an open end of the inner housing to restrain the locking plates from escaping via the open end.

5. The lock as defined in claim 4, wherein the annular slot and the position slot are provided at an exterior side of the driving section.

6. The lock as defined in claim 1, further comprising a spring, which an end thereof is exerted on the driving section of the inner housing to push the inner housing to the close end of the outer housing.

7. A lock, comprising:

an outer housing, which is open at an end thereof and is close at the other end thereof, having an outer slot at an interior side thereof, a key bore at the close end thereof and a plurality of first locking pins and springs at a periphery thereof, wherein the first locking pins are reciprocated along a radial orientation of the outer housing and the spring are exerted on the first locking pins respectively;

an inner housing received in the outer housing for rotation between a predetermined angle, wherein the inner housing has an inner slot, which is open at both an interior side and an exterior side thereof, and a driving section, and a plurality of second locking pins at a periphery thereof, wherein the second locking pins are reciprocated along a radial orientation of the inner housing;

a plurality of locking plates received in the inner housing in sequence and rotated between a predetermined angle, each of which has a key bore at a center thereof and a recesses at a periphery thereof;

wherein the inner housing is reciprocated in the outer housing between a first position and a second position and has an annular slot and a position slot, which is communicated with the annular slot, at the exterior side thereof, and a first tumbler pin provided at the outer housing and having an inner end thereof received either in the annular slot or in the position slot of the inner housing;

wherein the first tumbler pin is received to the position slot of the inner housing to restrain the inner housing from rotation while the inner housing is moved to the first position and the first tumbler pin is received to the annular slot of the inner housing to release the inner housing for free rotation while the inner housing is moved to the second position.

* * * * *